US008012597B2

(12) United States Patent
Watanabe et al.

(10) Patent No.: US 8,012,597 B2
(45) Date of Patent: Sep. 6, 2011

(54) CAST PRODUCT HAVING ALUMINUM-BASED FILM AND PROCESS FOR PRODUCING THE SAME

(75) Inventors: Botaro Watanabe, Iwanuma (JP); Takeshi Hirama, Watari-gun (JP)

(73) Assignee: Keihin Corporation, Tokyo (JP)

( * ) Notice: Subject to any disclaimer, the term of this patent is extended or adjusted under 35 U.S.C. 154(b) by 877 days.

(21) Appl. No.: 11/794,849

(22) PCT Filed: Jan. 6, 2006

(86) PCT No.: PCT/JP2006/300114

§ 371 (c)(1),
(2), (4) Date: Jul. 6, 2007

(87) PCT Pub. No.: WO2006/080183

PCT Pub. Date: Aug. 3, 2006

(65) Prior Publication Data

US 2009/0269607 A1 Oct. 29, 2009

(30) Foreign Application Priority Data

Jan. 7, 2005 (JP) ..... 2005-002723

(51) Int. Cl.

| | |
|---|---|
| ***B32B 3/10*** | (2006.01) |
| ***B32B 3/24*** | (2006.01) |
| ***B32B 15/04*** | (2006.01) |
| ***B32B 15/20*** | (2006.01) |
| ***B05D 1/02*** | (2006.01) |
| ***B05D 1/12*** | (2006.01) |

(52) U.S. Cl. ..... 428/600; 428/609; 428/612; 428/640; 428/650; 428/654; 428/658; 427/421.1; 427/427; 123/319; 164/1; 451/28

(58) Field of Classification Search ..... 428/609, 428/612, 640, 632, 633, 650, 654, 658, 666, 428/600, 601

See application file for complete search history.

(56) References Cited

U.S. PATENT DOCUMENTS

2006/0110619 A1 5/2006 Sato

FOREIGN PATENT DOCUMENTS

| | | |
|---|---|---|
| JP | 55-119101 | 9/1980 |
| JP | 56-093801 | 7/1981 |
| JP | 60-35432 | 8/1985 |

(Continued)

OTHER PUBLICATIONS

Machine Translation, Hashimoto, JP 2004-285373, Oct. 2004.*

(Continued)

*Primary Examiner* — Michael La Villa

(74) *Attorney, Agent, or Firm* — Nelson Mullins Riley & Scarborough LLP; Anthony A. Laurentano

(57) ABSTRACT

In a throttle body, a passive film and a corrosion-resistant film are stacked in that order on a substrate of aluminum. The passive film has a concave part on its corrosion-resistant film side. A metal layer is provided in the concave part. In shot blasting, upon collision of a blasting material against the corrosion-resistant film, a part of the blasting material is separated and adhered onto the resultant concaves to form the metal layer. For example, aluminum having a purity of not less than 98% is selected as the blasting material.

9 Claims, 3 Drawing Sheets

FOREIGN PATENT DOCUMENTS

| | | |
|---|---|---|
| JP | 62-3573 | 1/1987 |
| JP | 63-101080 | 5/1988 |
| JP | 02-019477 | 1/1990 |
| JP | 06-136563 | 5/1994 |
| JP | 9-78254 | 3/1997 |
| JP | 2004-76041 | 3/2004 |
| JP | 2004-285373 | 10/2004 |
| JP | 2005-329441 | 12/2005 |
| JP | 2006-043708 | 2/2006 |
| WO | WO 2004/024988 * | 3/2004 |

OTHER PUBLICATIONS

Machine Translation, Nishiguchi et al., JP 09-078254, Mar. 1997.*
Chinese Office Action Application No. 200680001877.6, dated Jan. 16, 2009.
Japanese Office Action for Application No. 2005-002723, dated Dec. 22, 2009.

* cited by examiner

FIG. 3

| | | SHOT MATERIAL FOR SHOT BLASTING | AREA RATIO A OF WHITE PRODUCT [%] |
|---|---|---|---|
| EXAMPLES | 1 | ALUMINUM | 5 |
| | 2 | ZINC | 5 |
| COMPARATIVE EXAMPLES | 1 | STEEL | 15 |
| | 2 | STAINLESS STEEL | 20 |
| | 3 | ZINC + C | 20 |
| | 4 | NONE | 15 |

CAST PRODUCT HAVING ALUMINUM-BASED FILM AND PROCESS FOR PRODUCING THE SAME

TECHNICAL FIELD

The present invention relates to a cast product having an aluminum-based film wherein a passivation film, which is formed on an underlying material composed of aluminum or aluminum alloy, is coated with a corrosion-resistant coating film, and a method of (process for) producing the same.

BACKGROUND ART

Structural members composed of aluminum or aluminum alloy have advantages that, for example, the weight is light and the deformation can be easily performed in order to obtain a predetermined shape, because processes can be easily applied. The structural members are used in a variety of fields, for example, for carburetors and throttle bodies as constitutive parts of automobiles.

Such a structural member is manufactured as follows. That is, for example, a mold is filled with a molten metal of aluminum or aluminum alloy, and then the molten metal is cooled and hardened to provide a cast product. In order to improve the corrosion resistance, the surface of the cast product is coated with a corrosion-resistant coating film.

Conventionally, such a corrosion-resistant coating film is provided by immersing the cast product in a chromate treatment liquid containing $CrO_3$, i.e., hexavalent chromium, as described in Patent Document 1. For this reason, hexavalent chromium is also contained in the corrosion-resistant coating film. However, hexavalent chromium is a substance which imposes the load on the environment. Therefore, in recent years, investigations have been made in order to form a corrosion-resistant coating film containing no hexavalent chromium.

From the above viewpoint, the present applicant has proposed the following invention in Patent Document 2. Specifically, a Zn underlayer is formed on a structural member composed of aluminum or aluminum alloy.
Subsequently, a chromate coating film (corrosion-resistant coating film) that contains trivalent chromium, is formed on the Zn underlayer.

Patent Document 1: Japanese Patent Publication No. 60-35432;

Patent Document 2: Japanese Laid-Open Patent Publication No. 2004-76041.

DISCLOSURE OF THE INVENTION

A principal object of the present invention is to provide a cast product having an aluminum-based film, provided with a coating film which is excellent in corrosion resistance.

Another object of the present invention is to provide a cast product having an aluminum-based film which makes it possible to avoid imposing the load on the environment.

Still another object of the present invention is to provide a method of producing a cast product having an aluminum-based film, in which a coating film excellent in corrosion resistance is provided on aluminum or aluminum alloy.

Still another object of the present invention is to provide a method of producing a cast product having an aluminum-based film, which makes it possible to avoid imposing the load on the environment when the coating film is provided on aluminum or aluminum alloy.

According to one aspect of the present invention, there is provided an aluminum-based cast product having a film comprising a base material which has a passivation film formed on a surface of an underlying material composed of aluminum or aluminum alloy, and a corrosion-resistant coating film with which the passivation film is coated and which has corrosion resistance higher than that of the underlying material, wherein:

recesses are formed on a side of the corrosion-resistant coating film on the passivation film; and a metal layer, which is composed of aluminum having a purity of not less than 98%, zinc having a purity of not less than 98%, or aluminum-zinc alloy having a purity of not less than 98%, exists in each of the recesses. In the present invention, the term "aluminum-based" generally refers to aluminum and aluminum alloy.

When the metal layer exists as described above, the corrosion-resistant coating film is formed sufficiently. Therefore, it is possible to obtain the cast product which is excellent in the corrosion resistance.

It is preferable that the corrosion-resistant coating film is a film which is free from hexavalent chromium, i.e., a film which contains no hexavalent chromium. In this case, it is unnecessary to use any gas or any liquid containing hexavalent chromium, for example, a hexavalent chromate treatment liquid. Therefore, it is possible to avoid imposing the load on the environment.

A preferred example of the corrosion-resistant coating film may include a chromate coating film containing trivalent chromium.

According to another aspect of the present invention, there is provided a method of producing a cast product having an aluminum-based film, comprising the steps of:

obtaining the cast product by performing a casting process using a molten metal of aluminum or aluminum alloy;

blasting the cast product having a formed passivation film with a blasting material composed of aluminum having a purity of not less than 98%, zinc having a purity of not less than 98%, or aluminum-zinc alloy having a purity of not less than 98%, to provide recesses on the passivation film and to form a metal layer originating from the blasting material in each of the recesses; and providing, on the passivation film, a corrosion-resistant coating film having corrosion resistance higher than that of aluminum or aluminum alloy.

In the present invention, the cast product is blasted with the blasting material composed of high purity aluminum, zinc, or aluminum-zinc alloy during the shot blasting to provide the metal layer, and then the corrosion-resistant coating film is provided.

When the high purity metal layer is provided by the shot blasting, the corrosion-resistant coating film can be grown sufficiently in the next step. As a result, it is possible to obtain the cast product which is satisfactory in the corrosion resistance.

As described above, the corrosion-resistant coating film is grown sufficiently. As a result, it is possible to obtain the cast product which is excellent in the corrosion resistance.

In the shot blasting, the blasting is performed with blasting materials. The shot blasting is a technical procedure to be performed, for example, when burrs are removed from a cast product, when the paint is exfoliated and removed, and when a residual stress is applied to a workpiece. However, the technique, in which the shot blasting is performed in order to provide the metal layer originating from the blasting material on the passivation film in the present invention, has heretofore been unknown.

It is preferable that a film, which is free from hexavalent chromium, is provided as the corrosion-resistant coating film as described above, for the following reason. That is, in this case, it is possible to avoid imposing the load on the environment. For example, it is appropriate that a chromate coating film, which contains trivalent chromium, is provided as the corrosion-resistant coating film.

BRIEF DESCRIPTION OF THE DRAWINGS

FIG. 3 is a table showing the corrosion resistances of throttle bodies of Examples 1 and 2 and Comparative Examples 1 to 4.

BEST MODE FOR CARRYING OUT THE INVENTION

A cast product having an aluminum-based film and a method of producing the same according to the present invention will be explained in detail below with reference to the accompanying drawings, as exemplified by preferred embodiments.

Figure 1:
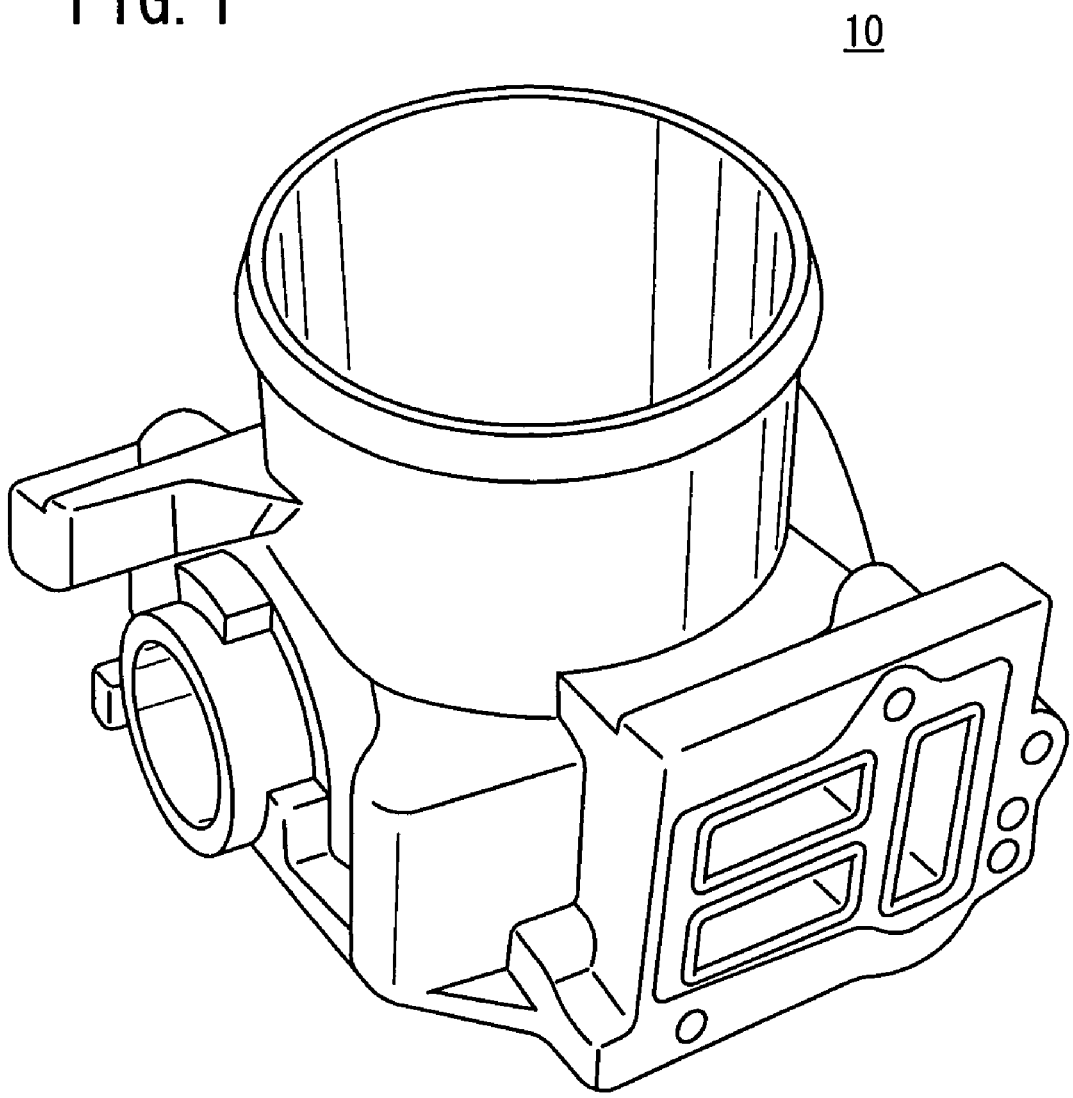
FIG. 1 is a schematic perspective view illustrating an entire throttle body composed of a cast product having an aluminum-based film according to an embodiment of the present invention.

FIG. 1 is a schematic perspective view illustrating an entire throttle body 10 composed of a cast product having an aluminum-based film according to an embodiment of the present invention. The throttle body 10 as a cast product can be obtained by filling a mold with a molten metal of aluminum and then cooling and hardening the molten metal.

Figure 2:
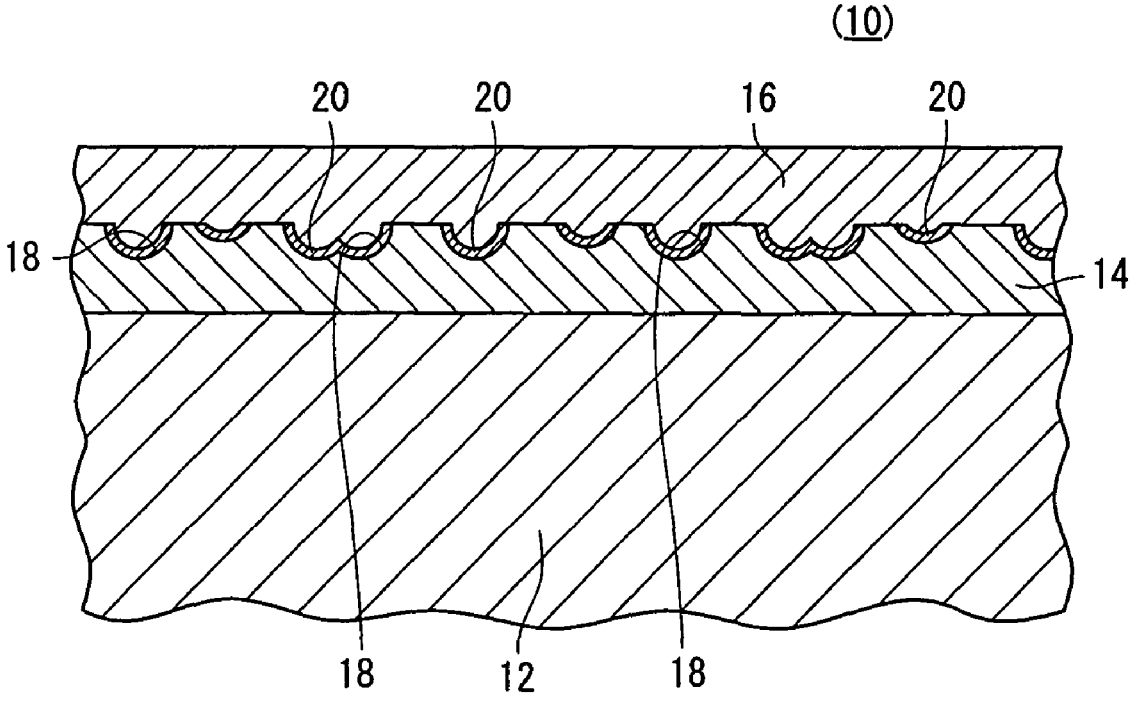
FIG. 2 is an enlarged sectional view illustrating a surface layer portion of the throttle body shown in FIG. 1.

FIG. 2 is an enlarged cross section of the throttle body 10 of this embodiment. The throttle body 10 has an underlying material or substrate 12 composed of aluminum. A passivation film 14 as an oxide film and a corrosion-resistant coating film 16 are stacked in this order on the underlying material 12.

The passivation film 14 is formed by spontaneous oxidation of the underlying material 12 (aluminum) when the cast product is cooled and hardened in the atmosphere, as described later on.

Recesses or concave parts 18 are formed on the passivation film 14 in the vicinity of the boundary with respect to the corrosion-resistant coating film 16. In other words, the recesses 18 exist on the side of the corrosion-resistant coating film 16 on the passivation film 14. Metal layers 20, which are composed of aluminum having a purity of not less than 98%, are adhered to the respective recesses 18 such that the shapes of the metal layers 20 substantially corresponds to the shapes of the recesses 18.

The recesses 18 are formed while the blasting materials collide against the cast product when the shot blasting is applied to the cast product, as described later on. The metal layer 20 is formed by abrasing part of the blasting materials and then remaining the abrased materials in the recesses 18, during the collision.

In this embodiment, the corrosion-resistant coating film 16, which is formed on the passivation film 14, is a chromate coating film containing trivalent chromium. Owing to the presence of the corrosion-resistant coating film 16, the underlying material 12, in other words, the throttle body 10, is remarkably prevented from corroding.

No hexavalent chromium is contained in the corrosion-resistant coating film 16. That is, according to the embodiment of the present invention, it is unnecessary to use any chemical that imposes the load on the environment, such as a chromate treatment liquid containing hexavalent chromium. Therefore, it is also possible to contribute to the environment protection.

Next, an explanation will be made about a method of producing a cast product having an aluminum-based film according to an embodiment of the present invention, as exemplified by a case in which the throttle body 10 is manufactured.

At first, a mold is filled with a molten metal of aluminum, and the casting process is performed to provide the shape of the throttle body 10.

The molten metal is solidified in the mold to provide the cast product. The mold is opened after the elapse of a predetermined period of time, thereby to release the cast product from the mold. Thereafter, the cast product is left in the atmosphere for a predetermined period of time, during which the solidification is advanced to inner portions.

The oxide film is spontaneously formed on the surface layer portion of the cast product left (cooled) in the atmosphere while aluminum, which is a material of the cast product, is oxidized by water existing on the mold etc. and oxygen existing in the atmosphere. Accordingly, the underlying material 12 and the passivation film 14 are formed on the cast product.

Subsequently, the shot blasting is performed on the cast product. Specifically, the cast product is blasted with the spherical blasting materials as generally performed in the removal of burrs and the exfoliation and removal of the paint, or the like.

A material, which is composed of aluminum having a purity of not less than 98%, is selected for the blasting material. If the purity is less than 98%, then it is difficult to obtain satisfactory corrosion resistance even when any corrosion-resistant coating film 16 is formed. It is more preferable to select a material having a purity of not less than 99%.

The particle size of the blasting material is not specifically limited. However, it is appropriate that the particle size is from 0.7 to 0.9 mm, for example, about 0.8 mm. Also, the blasting speed and the blasting time of the blasting materials are not specifically limited. However, when the blasting speed is set to 60 to 70 m/sec, for example, about 66 m/sec, it is appropriate that the blasting time is set to about 1 minute.

The blasted blasting materials collide with the passivation film 14. As a result of the collision, the recesses 18 are formed on the passivation film 14. Materials, which are exfoliated from the blasting materials, remain and adhere onto the recesses 18. Accordingly, the metal layer 20, which has a shape substantially corresponding to the shape of the recess 18, is formed. The metal layer 20 is composed of aluminum as the material of the blasting material.

The formed metal layer 20 can be confirmed, for example, by X-ray photoelectron spectroscopic analysis (XPS) method.

Subsequently, for example, a process such as a punching process and a cutting process is applied to predetermined portions of the cast product after the shot blasting, and then a known pretreatment is performed. Specifically, washing with hot water, degreasing, washing with water, activation, washing with water, and washing with hot water are successively applied.

Subsequently, the corrosion-resistant coating film 16 is provided on the passivation film 14. In this embodiment, the cast product is immersed in a chromate treatment liquid containing trivalent chromium. As a result of the immersion, the chromate coating film containing trivalent chromium is grown. As a result, the corrosion-resistant coating film 16 containing trivalent chromium is formed. Such a chromate treatment liquid includes ALT 610 (trade name of treatment liquid produced by Dipsol).

As described above, in the embodiment of the present invention, it is unnecessary to use chromate treatment liquid containing hexavalent chromium. Therefore, it is possible to remarkably reduce the load imposed on the environment.

If the shot blasting is not performed, the corrosion-resistant coating film 16 is not formed sufficiently. For this reason, it is difficult to obtain sufficient corrosion resistance. According to this fact, the reason why the corrosion-resistant coating film 16 is formed sufficiently by performing the shot blasting, is that the chromate coating film is easily formed owing to the presence of the metal layer 20 composed of high purity aluminum.

The throttle body 10, on which the corrosion-resistant coating film 16 is provided as described above, exhibits the excellent corrosion resistance owing to the presence of the corrosion-resistant coating film 16.

In the embodiment described above, a material that is composed of aluminum having a purity of not less than 98%, is selected as the blasting material to be used when the shot blasting is performed. However, the blasting material may comprise zinc having a purity of not less than 98%. Alternatively, the blasting material may comprise aluminum-zinc alloy, provided that the alloy has an aluminum-zinc content of not less than 98%. Also, two or more of the above may be simultaneously used.

The throttle body 10 may comprise aluminum alloy (for example, ADC 12). Further, the aluminum-based cast product according to the present invention is not especially limited to the throttle body 10. The cast product may include any other product, such as a carburetor main body, provided that the cast product is produced from a molten metal of aluminum or aluminum alloy.

The material of the corrosion-resistant coating film 16 is not especially limited to the chromate coating film containing trivalent chromium. It is possible to use any coating film (coating film free from hexavalent chromium) that is excellent in the corrosion resistance as compared with aluminum or aluminum alloy of the underlying material 12 and that contains no hexavalent chromium.

The method for providing the corrosion-resistant coating film 16 is not especially limited to the method in which the treatment liquid is used. It is also possible to adopt any other film formation method including the chemical vapor deposition (CVD) method and the physical vapor deposition (PVD) method.

EXAMPLE 1

A mold was filled with a molten metal of aluminum alloy (ADC 12), and the casting process was performed to provide a shape of a throttle body 10. The mold was opened after a predetermined period of time had elapsed, and the product was released from the mold to obtain the cast product, followed by being left in the atmosphere.

Subsequently, the shot blasting was performed on the cast product using spherical blasting materials composed of aluminum having a purity of not less than 99%. The particle size of the blasting material was about 0.8 mm, and the blasting speed and the blasting time of the blasting materials were about 66 m/sec and about 1 minute, respectively. After the completion of the blasting, an extreme surface portion of the cast product was analyzed by XPS method. As a result, the analysis showed that aluminum was present on the passivation film 14. In the analysis based on XPS method, the surface of the cast product was etched with argon gas to a depth of 0.005 μm.

Subsequently, the cast product after the shot blasting was subjected to washing with hot water, degreasing, washing with water, activation, and washing with water.

The cast product was immersed in ALT 610 as a chromate treatment liquid containing trivalent chromium to provide a corrosion-resistant coating film 16. This sample is designated as Example 1.

Alternatively, a corrosion-resistant coating film 16 was provided in accordance with Example 1 except that spherical blasting materials, which were composed of zinc having a purity of not less than 99%, were used. This sample is designated as Example 2.

For comparison, corrosion-resistant coating films 16 were provided in accordance with Examples 1 and 2 except that blasting materials composed of steel material, blasting materials composed of stainless steel, and mixed blasting materials having 95 volume % of zinc blasting materials having a purity of not less than 99% and 5 volume % of carbon blasting materials were used. These samples are designated as Comparative Examples 1 to 3, respectively.

A corrosion-resistant coating film 16 was provided in accordance with Example 1 except that the blasting shot was not performed. This sample is designated as Comparative Example 4.

A corrosion resistance test was performed on the throttle bodies of Examples 1 and 2 and Comparative Examples 1 to 4, as described above. Specifically, the salt spray test was performed, in which salt water was sprayed. The area ratio A of the white product, which was obtained 48 hours after the start of the spray, was determined in accordance with the following expression (1).

$$A\ (\%) = (\text{area of white product}/\text{total surface area of throttle body}) \times 100 \quad (1)$$

The white product is produced as a result of the corrosion of aluminum. Therefore, a smaller value of A means more excellent corrosion resistance. The area of the white product was determined as follows. That is, the generated region, which was visually confirmed, was measured, and the generated region was converted into the area.

Results are shown in FIG. 3 in combination. As can be seen from FIG. 3, it is clear that the throttle body 10, which is satisfactory in the corrosion resistance, is obtained by performing the shot blasting by using the blasting material composed of high purity aluminum or zinc, as compared with the case in which blasting materials composed of any other material or low purity blasting materials are used or the case in which the shot blasting is not performed.

The invention claimed is:

1. An aluminum-based cast product having a film comprising a passivation film formed on a surface of an underlying material composed of aluminum or aluminum alloy and a corrosion-resistant coating film with which said passivation film is coated and which has corrosion resistance higher than that of said underlying material, wherein:

recesses are formed on said passivation film on a side which faces said corrosion-resistant coating film; and a metal layer, which is composed of aluminum with a purity of not less than 98% , zinc with a purity of not less than 98%, or aluminum-zinc alloy having an aluminum-zinc content of not less than 98%, exists in each of said recesses.

2. The aluminum-based cast product having said film according to claim 1, wherein said corrosion-resistant coating film comprises a coating film that is free from hexavalent chromium.

3. The aluminum-based cast product having said film according to claim 2, wherein said corrosion-resistant coating film comprises a chromate coating film that contains trivalent chromium.

4. The aluminum-based cast product having said film according to claim 1, wherein said aluminum-based cast product having said film comprises a throttle body.

5. A method of producing an aluminum-based cast product having a film, comprising the steps of:

obtaining a cast product by performing a casting process using a molten metal of aluminum or aluminum alloy;

blasting said cast product having a passivation film with a blasting material composed of aluminum with a purity of not less than 98%, zinc with a purity of not less than 98%, or aluminum-zinc alloy having an aluminum-zinc content of not less than 98%, to provide recesses on said passivation film and to form a metal layer originating from said blasting material in each of said recesses; and providing, on said passivation film, a corrosion-resistant coating film having corrosion resistance higher than that of aluminum or aluminum alloy, such that a side of the passivation film formed with the recesses faces the corrosion-resistant coating film.

6. The method of producing said aluminum-based cast product having said film according to claim 5, wherein said corrosion-resistant coating film comprises a coating film that is free from hexavalent chromium.

7. The method of producing said aluminum-based cast product having said film according to claim 6, wherein said corrosion-resistant coating film comprises a chromate coating film that contains trivalent chromium.

8. The method of producing said aluminum-based cast product having said film according to claim 7, wherein said aluminum-based cast product is immersed in a trivalent chromate treatment liquid containing trivalent chromium when said chromate coating film is provided.

9. The method of producing said aluminum-based cast product having said film according to claim 6, wherein a throttle body is manufactured as said aluminum-based cast product using said molten metal.

* * * * *